US009022261B2

(12) United States Patent
Hembo et al.

(10) Patent No.: US 9,022,261 B2
(45) Date of Patent: May 5, 2015

(54) WATCH COMPRISING INTERCHANGEABLE STRAP CONNECTING MEANS

(71) Applicants: Claus Skødt Hembo, Herning (DK); Christina Arvin Hembo, Herning (DK)

(72) Inventors: Claus Skødt Hembo, Herning (DK); Christina Arvin Hembo, Herning (DK)

( * ) Notice: Subject to any disclaimer, the term of this patent is extended or adjusted under 35 U.S.C. 154(b) by 0 days.

(21) Appl. No.: 13/972,227

(22) Filed: Aug. 21, 2013

(65) Prior Publication Data

US 2015/0055440 A1 Feb. 26, 2015

(51) Int. Cl.

| | |
|---|---|
| ***A44C 5/14*** | (2006.01) |
| ***G04B 37/14*** | (2006.01) |
| *A44C 25/00* | (2006.01) |

(52) U.S. Cl.

CPC ..... *G04B 37/1486* (2013.01); *A44C 5/14* (2013.01); *A44C 5/142* (2013.01); *A44C 25/007* (2013.01)

(58) Field of Classification Search

CPC ..... G04B 37/1486; A44C 5/14
USPC ..... 224/164–179, 219; D10/32; D11/3; 24/265 B, 265 WS; 368/281–283
See application file for complete search history.

(56) References Cited

U.S. PATENT DOCUMENTS

| | | | | | |
|---|---|---|---|---|---|
| 2,811,294 | A * | 10/1957 | Sand | 224/172 |
| 2,870,511 | A * | 1/1959 | Sand | 24/265 B |
| 3,824,783 | A * | 7/1974 | Nadeau | 368/282 |
| 4,564,308 | A * | 1/1986 | Ikegami et al. | 403/166 |
| 5,323,554 | A * | 6/1994 | MacDonald | 40/633 |
| 5,483,505 | A * | 1/1996 | Cartier | 368/282 |
| 7,430,787 | B2 * | 10/2008 | Loetscher | 24/265 B |
| 7,690,088 | B2 * | 4/2010 | Kogen | 24/303 |
| 8,225,625 | B2 * | 7/2012 | Heiden et al. | 63/3 |
| 2011/0197400 | A1 * | 8/2011 | Chevrolet | 24/265 B |
| 2014/0101893 | A1 * | 4/2014 | Dornhege | 24/3.2 |

* cited by examiner

*Primary Examiner* — Justin Larson
(74) *Attorney, Agent, or Firm* — Roberts Mlotkowski Safran & Cole, P.C.; David S. Safran

(57) ABSTRACT

A watch comprising a watch case with opposite arranged connecting parts in form of two parallel branches for the mounting of a watch strap or cord between said branches, where said watch further comprises at least one generally T-shaped strap or cord connector comprising a spring loaded sliding bar suited for engaging in holes provided in a surface of each branch facing each other, said T-shaped strap or cord connector further comprises a cord receiving opening being arranged opposite to the spring loaded sliding bar and being an opening adapted to receive a cord having generally round or polygonal cross section, said cord at a first end and a second end being provided with interacting locking parts.

5 Claims, 6 Drawing Sheets

WATCH COMPRISING INTERCHANGEABLE STRAP CONNECTING MEANS

FIELD OF THE INVENTION

The present invention relates to a watch comprising interchangeable strap connecting means and of the type indicated in the preamble to claim 1.

BACKGROUND OF THE INVENTION

Watches evolved in the 17th century and have changed their appearance over time affected by the whims of fashion. For a multiplicity of years, the watches have been considered as not only a practical element for telling the time but also as a piece of jewelry.

Therefore, watches do not only compete according to their function but also according to their appearance. Different types of decorations on watches were designed over the years and watches can be acquired for every occasion.

OBJECT OF THE INVENTION

It is the object of the invention to provide a watch being constructed in such way that aesthetic appearance of a watch and more precisely cord parts thereof can easily be changed according to the wish of the user.

It is further the object of the invention to enable movable charms to be added, replaced or removed from the cord of the watch in a simple and easy manner by the user.

DESCRIPTION OF THE INVENTION

The watch according to the invention is distinctive by further comprises at least one generally T-shaped strap or cord connector comprising a spring loaded sliding bar suited for engaging in holes provided in a surface of each branch facing each other, said T-shaped strap or cord connector further comprises a cord receiving opening being arranged opposite to the spring loaded sliding bar and being an opening adapted to receive a cord having generally round or polygonal cross section, said cord at a first end and a second end being provided with interacting locking parts.

In a simple and technical easy manner it is hereby obtained a new type of watch where the aesthetic appearance of the watch and more precisely cord parts thereof can easily be changed according to the wish of the user or owner.

At the same time the mentioned further object of the invention namely to enable movable charms to be added, replaced or removed from the cord of the watch in a simple and easy manner by the user can easily be fulfilled.

In a preferred embodiment of the invention the watch may be such provided that said spring loaded sliding bar is arranged in a bore extending in the longitudinal direction of the cross-beam of said T-shaped strap or cord connector and said cord receiving opening is arranged in the stem of said T-shaped strap or cord connector and extends through said stem with an orientation substantial parallel with the orientation of said bore.

It may further be advantageously that the watch according to the invention may be such provided that said spring loaded bar is provided with a slide button extending through a slit connected to the bore for obtaining an external operation of the spring loaded bar via the slide button which extends above the surface of the T-shaped strap or cord connector.

In a furthermore and preferred embodiment the watch according to the invention may be such provided that said cord has a round cross section and at a free end being provided with one part of said interacting locking parts in the form of a first cylindrical lock part having the same generally round cross section as that of said cord and preferably having a smaller diameter and at the other free end said cord is provided with a cooperation second cylindrical lock part having a larger diameter for surrounding said first cylindrical lock part.

Appropriately, the watch according to the invention may be such provided that said cord at a free end being provided with one part of said interacting locking parts in the form of a cylindrical lock part having the same generally round cross section as that of said leather cord, and wherein said leather cord at an second free end being provided with second part of said interacting locking parts in the form of a lock part adapted to receive said cylindrical lock part of said first free end.

According to an important object of the watch according to the invention said leather cord consist of genuine core leather of a leather-like imitation. In other word the cord consists of a flexible material chosen among leather, leather-like imitations, rubber, plastic or the like.

In accordance with said further object of the invention said cord being provided with a number of charms having round or polygonal openings fitting with the cross section of said leather cord.

Preferably, the watch according to the invention is such provided that said interacting locking parts form parts of a magnetic lock consisting of said cylindrical lock part having the same generally round cross section as that of said leather cord and of a lock part adapted to receive said cylindrical lock part of said first free end.

DETAILED DESCRIPTION OF EMBODIMENTS OF THE INVENTION

Figure 1:
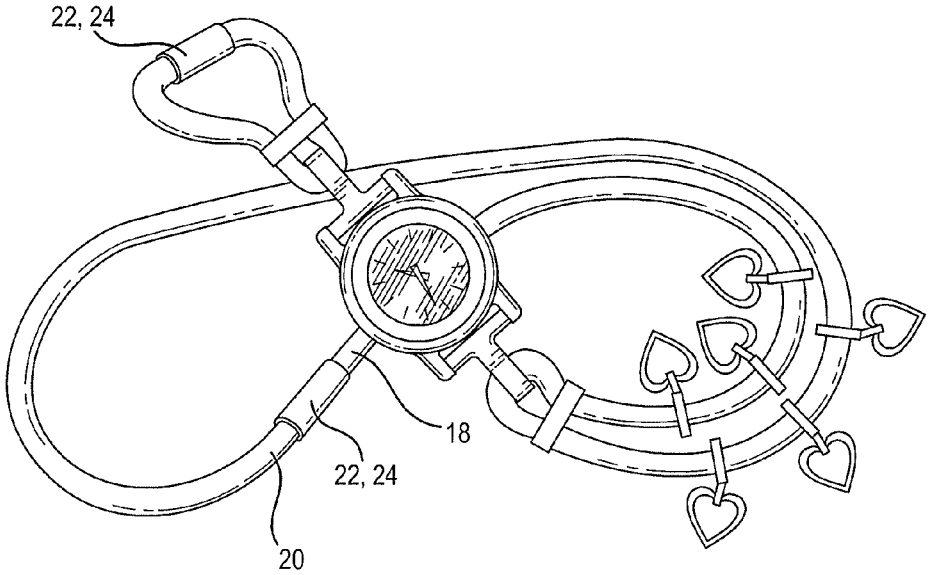
FIG. 1 illustrates an embodiment of a watch with a watch case with opposite connecting parts being provided with generally T-shaped connectors comprising a transverse opening for leather cords the free ends of which being provided with magnetic lock means.

FIG. 1 shows a jewelry-like watch 2 having a watch case 4 provided with connecting parts 6 in the form of two parallel branches 8 for the mounting of a watch strap or cord 10 consisting of a genuine leather core with round cross section. Said watch strap or cord 10 being connected to the connecting parts 6 by means of a generally T-shaped strap or cord connector 12.

Said T-shaped strap or cord connector 12 comprising a spring loaded sliding bar 14 suited for—as known per see—engaging in holes provided in a surface of each branch 8 facing each other.

Furthermore, said T-shaped strap or cord connector 12 comprises a cord receiving opening 16 being arranged opposite to the spring loaded sliding bar 14 and having an opening adapted to receive a cord 10 having generally round cross section, said cord 10 at a first end 18 and a second end 20 being provided with interacting locking parts 22, 24.

In the embodiment shown in FIG. 1 said interacting locking parts consist of a first cylindrical part 22, the cross section of which is similar to that of the round cord 10, and of a second wider cylindrical part 22 having an central opening for receiving said first cylindrical part 22—as the respective parts 22, 24 are in the form of interacting magnetic locking parts. In FIG. 1 said first cylindrical locking part 22 is not visible, because it is positioned inside the wider locking part 24.

At both sides of the connecting parts 6 the cord 10 stretches through a transverse cord holder 26 provided with two round mutually parallel openings so that the respective first partial runs of the watch cord 10 is almost parallel with each other short after said T-shaped cord connectors 12.

Figure 2:
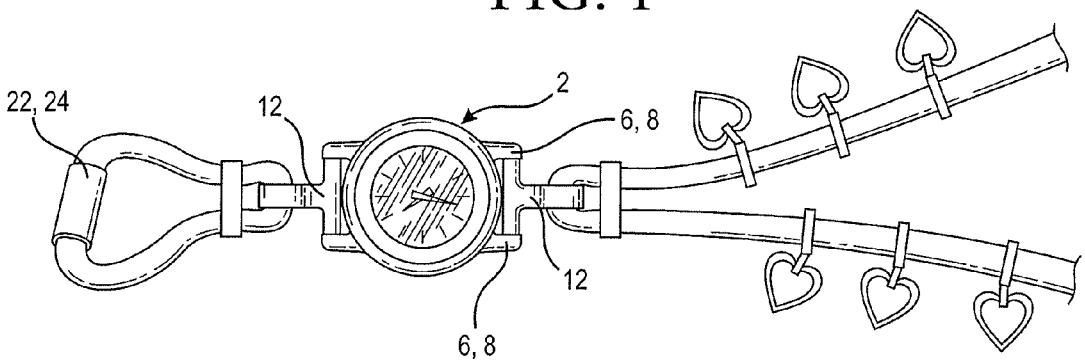
FIG. 2 illustrates the watch shown in FIG. 1—with the respective leather cord parts stretched out.

In FIG. 2 the watch cords 10 are stretched out to both sides of the watch case 4 and said transverse cord holders 24 are clearly visible together with said T-shaped cord connector 12.

Figure 3:
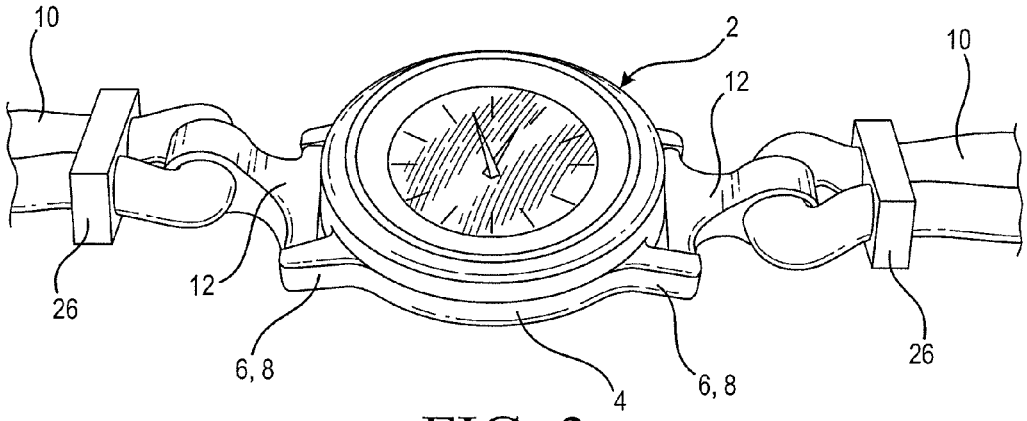
FIG. 3 illustrates an enlarged view of the watch shown in FIGS. 1 and 2, with only the respective end parts of the leather cords leading through said transverse openings of said generally T-shaped connectors.
Figure 4:
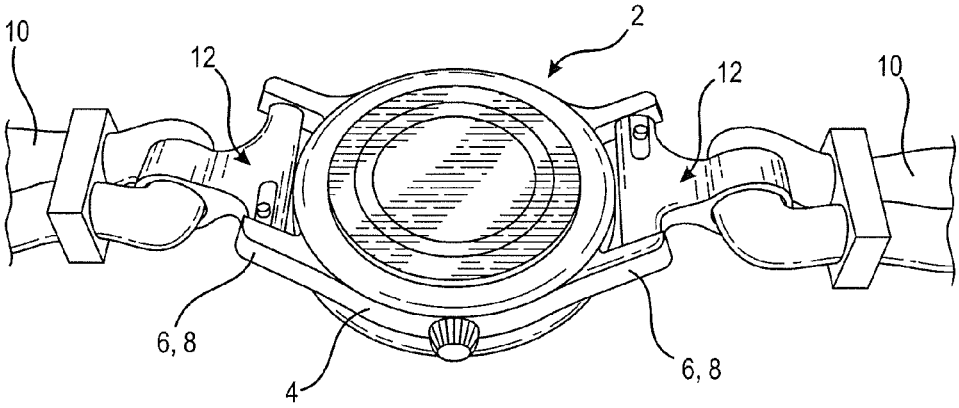
FIG. 4 illustrates an enlarged bottom side up view corresponding to the watch shown in FIG. 3.

In FIGS. 3 and 4 said transverse cord holders 24 are clearly visible together with said T-shaped cord connector 12.

Figure 5:
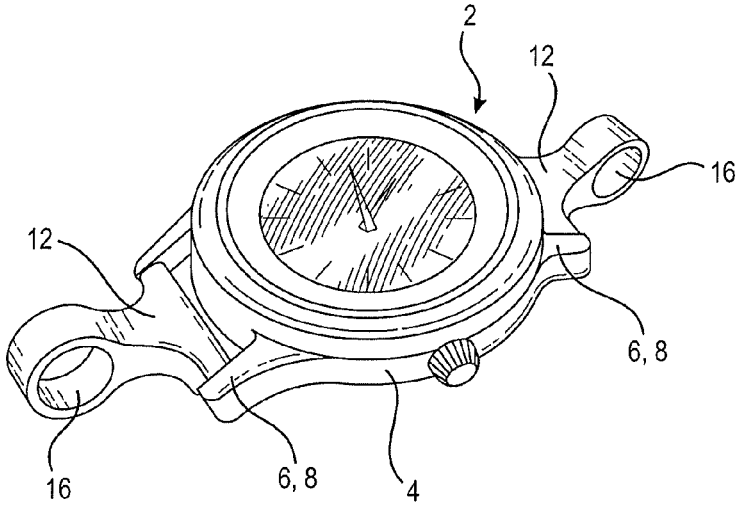
FIG. 5 illustrates a perspective view of a watch where the watch case connecting parts being mounted with said generally T-shaped connectors.

In FIG. 5 is only shown the watch case 4 and the T-shaped cord connectors 12 with said transverse cord receiving openings 14.

Figure 6:
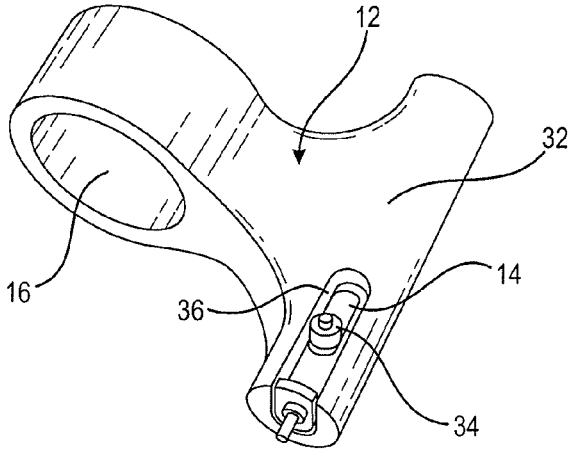
FIG. 6 illustrates a perspective enlarged view of a preferred embodiment of said generally T-shaped connector having said transverse opening for a preferable leather cord—as seen from the bottom side thereof.
Figure 7:
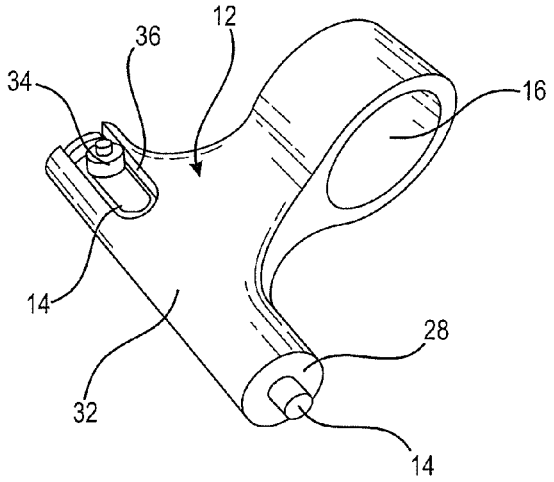
FIG. 7 illustrates a perspective enlarged view of a preferred embodiment of said generally T-shaped connector having said transverse opening for a preferable leather cord—as seen from the bottom side thereof and from another view point.

FIGS. 6 and 7 show the T-shaped cord connector 12—seen from the back side (bottom side) thereof. The spring loaded sliding bar 26 is arranged in a bore 28 extending in the longitudinal direction of the cross-beam 30 of said T-shaped strop or cord connector 12 and said cord receiving opening 16 is arranged in the stem 32 of said T-shaped strap or cord connector 12 and extends through said stem 32 with an orientation parallel with the orientation of said bore 28.

Said spring loaded bar 26 is provided with a slide button 34 extending through a slit 36 connected to the bore 28 for obtaining an external operation of the spring loaded bar 26 via the slide button 34 which extends above the bottom surface of the T-shaped strap or cord connector 12.

FIGS. 8-14 illustrate step by step the interchange of an original leather strap connector to a leather cord 10 provided with T-shaped connector 12 including an spring loaded sliding bar 26—adapted for external operation.

Figure 8:
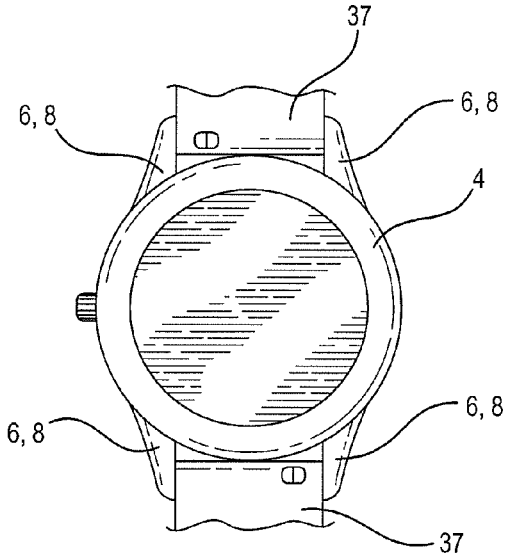
FIGS. 8-14 illustrate step by step the interchange of leather strap connector to leather cord with T-shaped connector including external operated spring loaded sliding bar.
Figure 9:
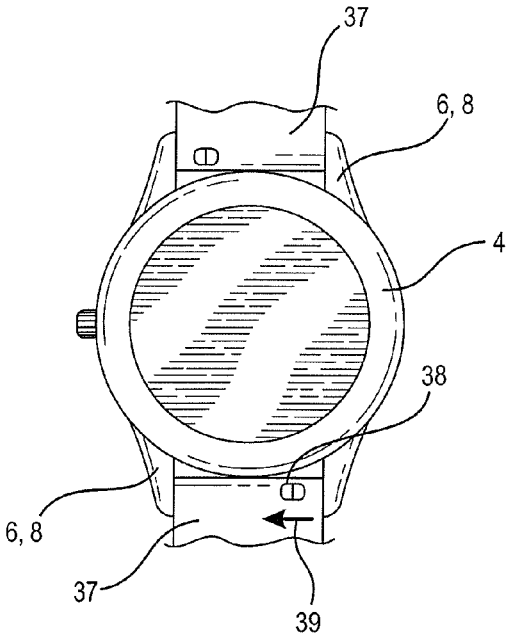
Figure 10:
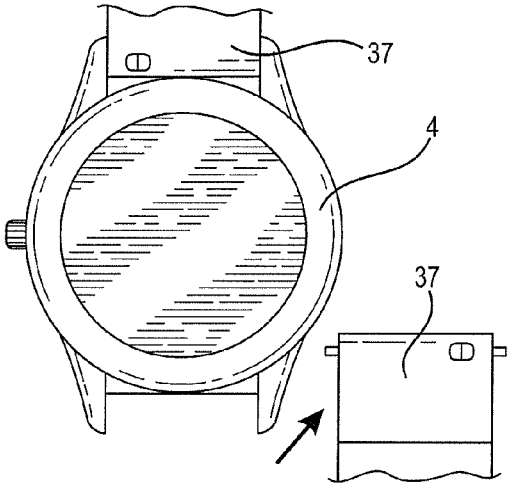

In FIG. 8 is shown a watch case 4 mounted with original leather strap connector 37. In FIG. 9 is shown how the leather strap connector 36 is released by pulling a sliding button 38 as illustrated with an arrow 39. And the leather strap connector 36 being taken out in FIG. 10.

Figure 11:
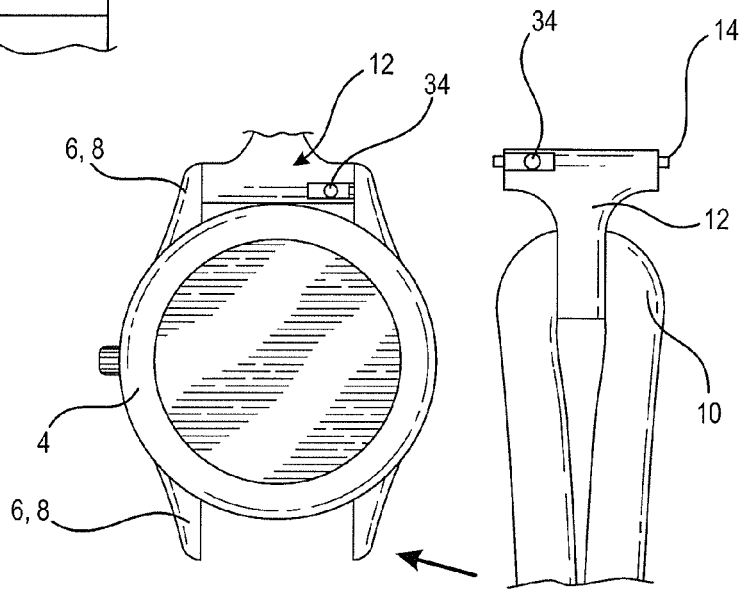

FIG. 11 illustrates a watch case 4 which at the top side is already mounted with a T-shaped cord connector 12 according to the present invention—and to the right hand side of the watch case 4 is shown a ready to mount T-shaped cord connector 12 already fitted with a leather cord 10.

Figure 12:
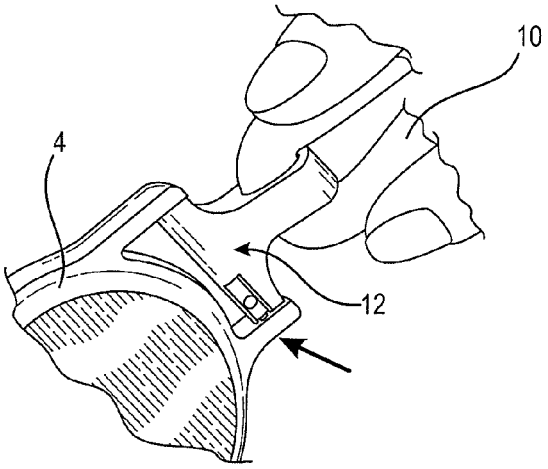
Figure 13:
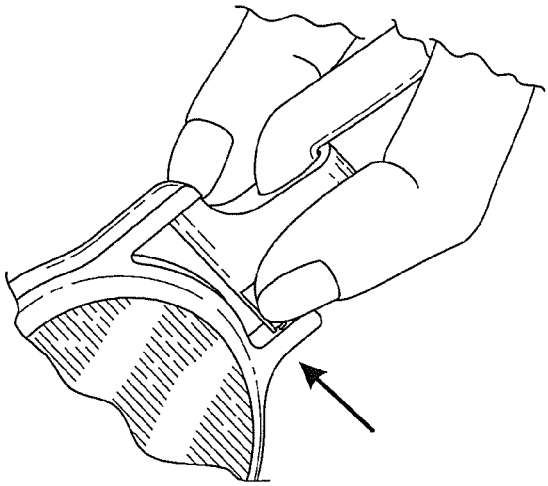
Figure 14:
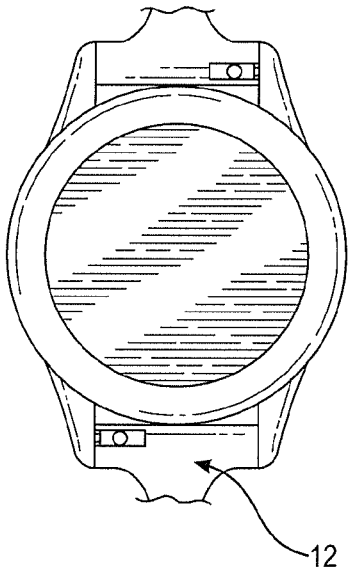
Figure 15:
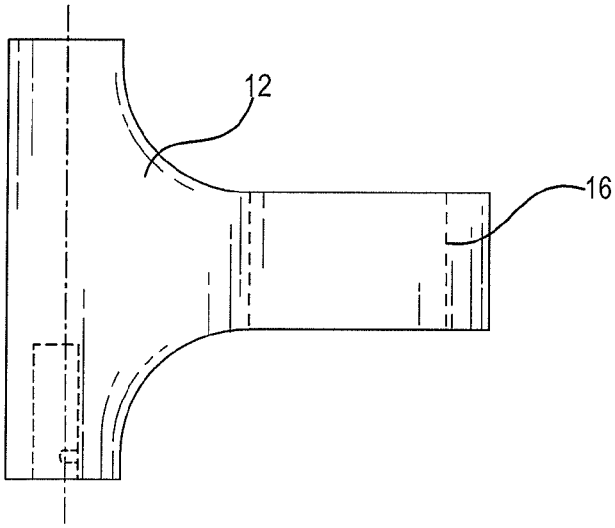
FIGS. 15-18 illustrate in more details the T-shaped strap or cord connector and the mounting thereof—at the connecting parts of the watch case.
Figure 16:
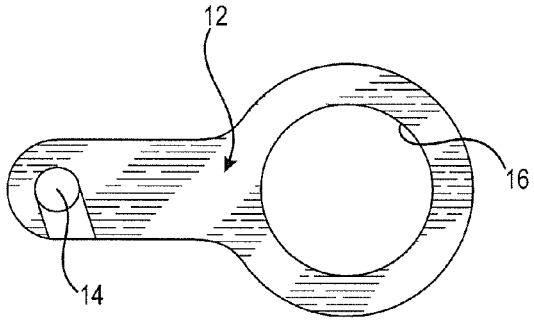
Figure 17:
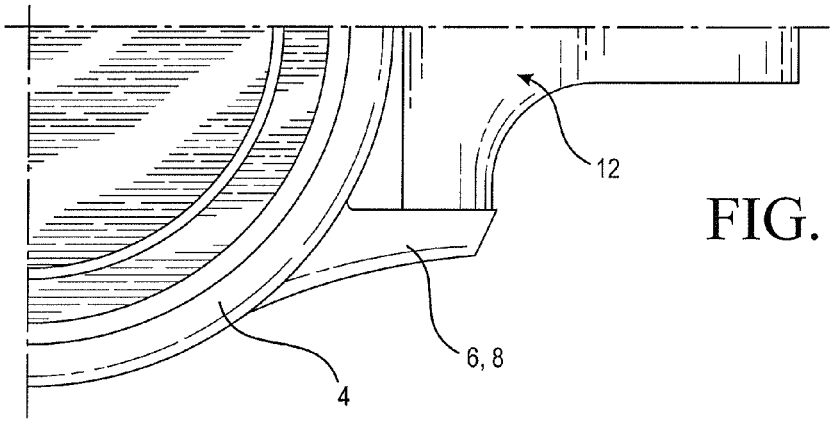
Figure 18:
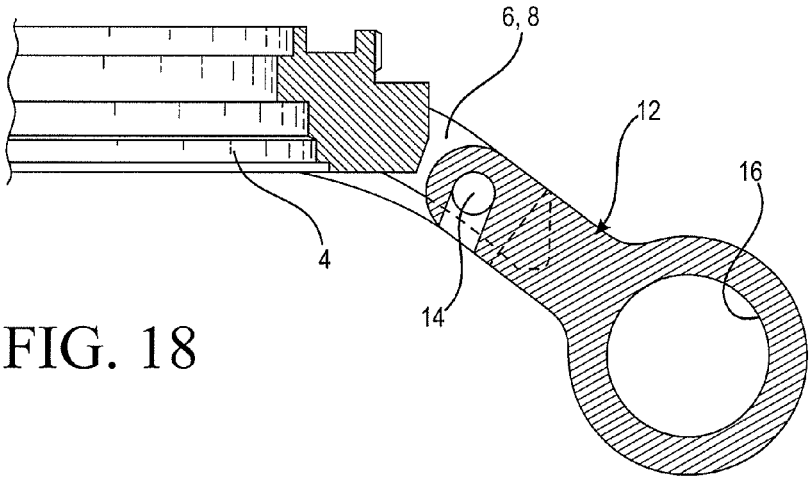

In FIG. 12 is illustrated how the T-shaped cord connector 12 is inserted between the branches 8 of the watch case 4, while FIG. 13 shows the final operation of the extending slide button 34 to secure correct mountings of the T-shaped cord connector 12. And in FIG. 14 the final result of the interchanging is shown—seen from the bottom side of the watch case 4.

In the remaining FIGS. 15-18 is used the same reference numerals for the respective parts described above.

The invention claimed is:

1. A watch comprising a watch case with oppositely arranged connecting parts in the form of two parallel branches for the mounting of a watch strap or cord between said branches, wherein said watch further comprises at least one generally T-shaped strap or cord connector comprising a spring loaded sliding bar suited for engaging in holes provided in a surface of each branch facing each other, said T-shaped strap or cord connector further comprising a cord receiving opening being arranged opposite to the spring loaded sliding bar and being an opening adapted to receive a cord having generally round or polygonal cross section, said cord at a first end and a second end being provided with interacting locking parts, wherein said cord has a round cross section and at a free end being provided with a first part of said interacting locking parts in the form of a first cylindrical lock part having the same generally round cross section as that of said cord and at the other free end said cord is provided with a cooperation second cylindrical lock part having a larger diameter than said first cylindrical lock part for surrounding said first cylindrical lock part, wherein said interacting locking parts form parts of a magnetic lock; and wherein said cord is provided with a number of charms having round openings fitting with the round cross section of said cord.

2. A watch according to claim 1, wherein said spring loaded sliding bar is arranged in a bore extending in a longitudinal direction of a cross-beam of said T-shaped strap or cord connector and said cord receiving opening is arranged in a stem of said T-shaped strap or cord connector and extends through said stem with an orientation substantial parallel with the orientation of said bore.

3. A watch according to claim 1, wherein said spring loaded bar is provided with a slide button extending through a slit connected to the bore for obtaining an external operation of the spring loaded bar via the slide button which extends above the surface of the T-shaped strap or cord connector.

4. A watch according to claim 1, wherein said cord is formed of leather or imitation leather.

5. A watch according to claim 1, wherein said first cylindrical lock part has a smaller diameter than said cord.

* * * * *